US010684571B2

(12) United States Patent
Nelson et al.

(10) Patent No.: US 10,684,571 B2
(45) Date of Patent: Jun. 16, 2020

(54) WET NULL VOLTAGES

(71) Applicant: HP INDIGO B.V., Amstelveen (NL)

(72) Inventors: Eric G. Nelson, Eagle, ID (US); Yoav Nachmias, Ness Ziona (IL); Michel Assenheimer, Kfar Sava (IL); Vitaly Portnoy, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/752,856

(22) PCT Filed: Aug. 19, 2015

(86) PCT No.: PCT/US2015/045918
§ 371 (c)(1),
(2) Date: Feb. 14, 2018

(87) PCT Pub. No.: WO2017/030581
PCT Pub. Date: Feb. 23, 2017

(65) Prior Publication Data

US 2018/0239273 A1 Aug. 23, 2018

(51) Int. Cl.
*G03G 15/10* (2006.01)
*G03G 15/06* (2006.01)
(Continued)

(52) U.S. Cl.
CPC ..... *G03G 15/065* (2013.01); *G03G 15/0815* (2013.01); *G03G 15/10* (2013.01);
(Continued)

(58) Field of Classification Search
CPC .... G03G 15/104; G03G 15/10; G03G 15/101; G03G 15/11; G03G 2215/0634; G03G 2215/0658
See application file for complete search history.

(56) References Cited

U.S. PATENT DOCUMENTS 5,066,988 A 11/1991 Miyake
6,067,427 A 5/2000 Shin
(Continued)

FOREIGN PATENT DOCUMENTS

CN 1493938 5/2004
CN 1645269 A 7/2005
(Continued)

OTHER PUBLICATIONS

Bartolic, T. et al.,"Impact of Printing Additional Inks on Multicolor Reproduction in Liquid Toner Electrophotography," International Conference on Materials, Tribology, Recycling, Jun. 27-29, 2013.
(Continued)

*Primary Examiner* — Walter L Lindsay, Jr.
*Assistant Examiner* — Jessica L Eley
(74) *Attorney, Agent, or Firm* — HP Inc. Patent Department

(57) ABSTRACT

An example system includes a power supply. The power supply is electrically coupled to an electrode, a developer roller, and a cleaner roller. The system also includes a controller. The controller is to instruct the power supply to reduce, at a first time, a magnitude of an electrode voltage supplied to the electrode. The controller also is to instruct the power supply to set, at a second time, a developer roller voltage and a cleaner roller voltage each to about a wet null voltage.

21 Claims, 8 Drawing Sheets

(51) Int. Cl.
*G03G 15/08* (2006.01)
*G03G 21/00* (2006.01)

(52) U.S. Cl.
CPC . *G03G 21/0058* (2013.01); *G03G 2215/0626* (2013.01); *G03G 2215/0658* (2013.01)

(56) References Cited

U.S. PATENT DOCUMENTS

| | | | | |
|---|---|---|---|---|
| 6,353,721 | B1 * | 3/2002 | Yamaguchi | B82Y 15/00 399/237 |
| 7,151,906 | B2 | 12/2006 | Chou et al. | |
| 7,400,850 | B2 | 7/2008 | Romem | |
| 7,421,223 | B2 | 9/2008 | Jodra et al. | |
| 7,668,488 | B2 | 2/2010 | Guzman et al. | |
| 7,792,444 | B2 | 9/2010 | Raz et al. | |
| 8,290,404 | B2 | 10/2012 | Raz | |
| 8,301,045 | B2 | 10/2012 | Ohshika | |
| 8,991,313 | B2 | 3/2015 | Lopez et al. | |
| 9,037,048 | B2 | 5/2015 | Berg et al. | |
| 2001/0026713 | A1 | 10/2001 | Nishikawa | |
| 2002/0057933 | A1 * | 5/2002 | Ebihara | G03G 15/0131 399/303 |
| 2007/0019996 | A1 * | 1/2007 | Romem | G03G 15/161 399/296 |
| 2010/0111552 | A1 | 5/2010 | Shiraki et al. | |
| 2010/0296825 | A1 | 11/2010 | Kella et al. | |
| 2011/0217082 | A1 * | 9/2011 | Frydman | G03G 15/1605 399/241 |
| 2011/0274452 | A1 | 11/2011 | Fukuyama et al. | |
| 2012/0201555 | A1 * | 8/2012 | Nishiyama | G03G 15/104 399/55 |
| 2014/0119758 | A1 | 5/2014 | Lee et al. | |
| 2015/0055984 | A1 | 2/2015 | Lior et al. | |
| 2015/0071665 | A1 | 3/2015 | Lam et al. | |
| 2015/0098717 | A1 | 4/2015 | Park et al. | |

FOREIGN PATENT DOCUMENTS

| | | |
|---|---|---|
| EP | 1429205 | 6/2004 |
| JP | 09326928 | 12/1997 |
| JP | 2000199996 | 7/2000 |
| JP | 2006154543 | 6/2006 |
| JP | 2008020761 | 1/2008 |
| JP | 5439362 | 3/2014 |
| KR | 1020050060489 | 6/2005 |

OTHER PUBLICATIONS

Anthony, Thomas C., et al. "ElectroInk Charge Retention in the HP Indigo LEP Press." NIP & Digital Fabrication Conference. vol. 2012. No. 2. Society for Imaging Science and Technology, 2012.

* cited by examiner

400

500

WET NULL VOLTAGES

BACKGROUND

Electro-photography (EP) printing devices may form images on print media by selectively charging or discharging a photoconductive drum based on an image to be printed. The selective charging or discharging may form a latent electrostatic image on the photoconductor. Colorant may be developed onto the latent image of the photoconductor, and the colorant may be transferred to the media to form the image on the media. In dry EP (DEP) printing devices, toner may be used as the colorant, and the toner may be received by the media as the media passes below the photoconductor. The toner may be fixed in place as it passes through heated pressure rollers. In liquid EP (LEP) printing devices, printing fluid may be used as the colorant instead of toner. In LEP devices, printing fluid may be developed in a developer unit and then selectively transferred to the photoconductor (a "zero transfer"). The photoconductor may transfer the printing fluid to an intermediate transfer member (ITM), which may include a transfer blanket, (a "first transfer"), where it may be heated until a liquid carrier evaporates and resinous colorants melt. The ITM may transfer the resinous colorants to the surface of the print media (a "second transfer"), which may be supported on a rotating impression drum.

DETAILED DESCRIPTION

Figure 1:
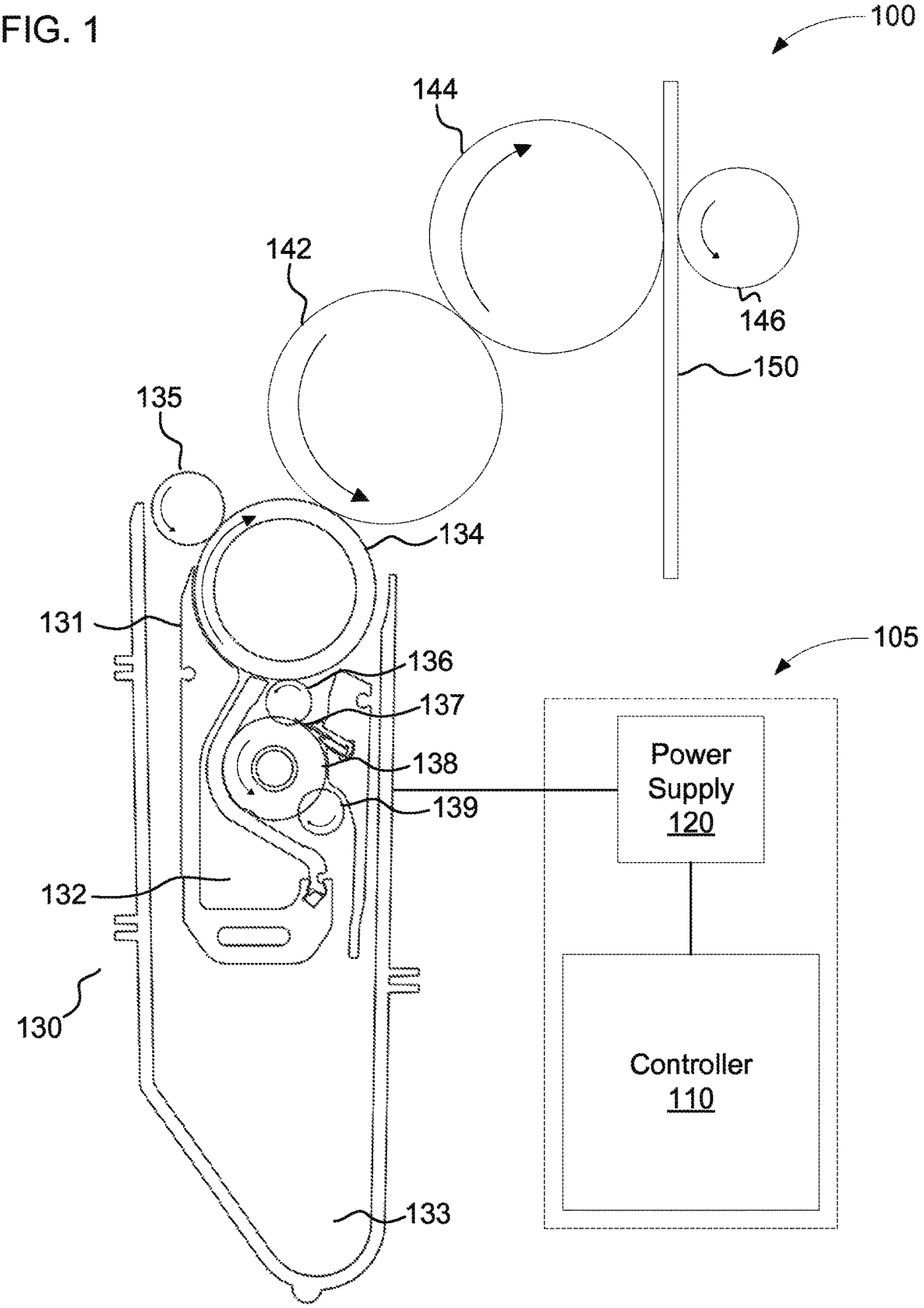
FIG. 1 is a schematic diagram of an environment containing an example system to remove developed printing fluid from a developer roller and to set the developer roller to about a wet null voltage.

During EP printing, there may be null cycles during which printing does not occur. Null cycles may be triggered by a component of a printing device that is not ready to print (e.g., by signaling an interrupt). Null cycles are stochastic events, and the timing of null cycles and the duration of a sequence of null cycles are unpredictable. During null cycles, components of the printing device may remain operational and ready to resume printing when the null cycle ends. However, there may be no zero transfer and thus no first transfer of printing fluid to the ITM.

The dry null cycle may cause damage to the ITM (e.g., to a transfer blanket). The ITM may be heated and charged during the null cycle. The lack of fluid on the ITM may allow for electrical breakdown of air between the photoconductor and the ITM. The breakdown may damage a release layer of the ITM, which may increase adhesion between the printing fluid and the release layer. In addition, the lack of fluid may dry the release layer, which may reduce swelling of the release layer and further degrade the releasing of printing fluid from the ITM. As a result, the transfer of images to and from the ITM may be negatively affected, and print quality may be degraded.

The harm from the dry null can be mitigated by transferring liquid to the ITM to wet it. The wetting may prevent electrical breakdown of the air and drying of the release layer. As used herein, the term "wet null cycle" refers to a period of time when a printing device is not printing but liquid is being delivered to an ITM. A wet null cycle may be performed by having a component with the sole function of delivering liquid during null cycles. However, the expense of the printing device would be increased by including such a component, and existing printing devices would have to be modified to include the component to deliver liquid to the ITM. Alternatively, a wet null cycle may be performed by having a developer unit transfer liquid to a photoconductor, which may deliver the liquid to the ITM.

A printing fluid may include a combination of liquids and solids. The solids may be charged, and the liquid may be mostly uncharged. The liquid may include a liquid carrier (e.g., a solvent, an oil, etc.). For example, the liquid may include a dielectric oil comprised of hydrocarbons of various weights. The solids may include a colorant, such as a number of pigments, a number of wax resins, or the like. The liquid or solids may also include numerous additional compounds, such as charge active agents, stabilization compounds, or the like. If solids (e.g., colorants) are transferred to the ITM during a wet null cycle, it may result in the solids being transferred to the print media when printing resumes. The solids may create an unwanted background image on the print media. Thus, background imaging may be minimized by transferring liquid to the ITM while minimizing the transfer of solids.

Rollers and static members (e.g., an electrode) in the developer unit may be adjusted to a set of wet null voltages to transfer the liquid to the photoconductor. As used herein, the term "wet null voltage" refers to a voltage selected so that liquid can be transferred to the photoconductor while transferring few or no solids. For example, the wet null voltage of a developer roller in contact with the photoconductor may be selected so that there is a small field between the developer roller and the photoconductor to prevent the transfer of the charged solids, but the mostly uncharged liquid may be able to transfer hydrodynamically. In an example, the photoconductor may have a voltage of −950 Volts (V), and a wet null voltage for the developer roller to transfer liquid but few or no solids may be −775 V. The small potential difference between the developer roller and the photoconductor may cause less current to flow between the developer roller and the photoconductor, which may result in less damage to the developer roller.

During printing, the developer unit may develop the printing fluid by increasing the concentration of solids in the printing fluid. Wet null voltages for each of an electrode and a squeegee roller may be selected to cease development of printing fluid. A wet null voltage for a cleaner roller may be selected to cease cleaning of the developer roller. However, if the electrode, the squeegee roller, the developer roller, and the cleaner roller are brought to about their wet null voltages at approximately the same time, there still may be developed printing fluid on the developer roller at the time it is set to about the wet null voltage. The developed printing fluid may be more likely to transfer solids to the photoconductor than undeveloped printing fluid. Accordingly, there is a need for a system that can remove developed printing fluid from the developer unit before the developer unit is set to about the wet null voltage.

FIG. 1 is a schematic diagram of an environment 100 containing an example system 105 to remove developed printing fluid from a developer roller 134 and to set the developer roller 134 to about a wet null voltage. The environment 100 may include an ITM 144 to print on a print medium 150 pressed against the ITM 144 by an impression drum 146. The ITM 144 may be in contact with a photoconductor 142. The photoconductor 142 may transfer printing fluid to the ITM 144 to create an image on the print media 150. A developer unit 130 may develop printing fluid and transfer the developed printing fluid to the photoconductor 142. The developer unit 130, photoconductor 142, ITM 144, impression drum 146, the print media 150, etc. are not drawn to scale but are instead sized to show the relevant features of the example. In addition, the illustrated example includes a single developer unit 130, but other examples may include additional developer units, such as a developer unit for each color (e.g., yellow, magenta, cyan, black, etc.), developer units for spot colors, or the like.

The developer unit 130 may include a printing fluid inlet 132. The printing fluid inlet 132 may receive printing fluid from a reservoir (not shown). The printing fluid may include a liquid and negatively charged solids. In one example implementation, the printing fluid may be 98% liquid and 2% solids when it is received at the inlet. The developer unit 130 may include an electrode 131. During printing, the electrode 131 may be charged to a large negative potential to cause the negatively charged solids to move to a developer roller 134. In one example, the electrode 131 may have a potential of −1975 V.

The printing fluid may coat the developer roller 134. The developer roller 134 may rotate and bring the printing fluid in contact with a squeegee roller 135. During printing, the squeegee roller 135 may be charged to a negative potential relative to the developer roller. In an example, the developer roller 134 may have a potential of −555 V, and the squeegee roller 135 may have a potential of −830 V. The squeegee roller 135 may remove liquids from the developer roller 134 while leaving negatively charged solids. For example, the squeegee roller may apply mechanical and electrical forces to the printing fluid that expel liquids from the printing fluid. In one example implementation, after passing the electrode 131 and the squeegee 135, the printing fluid on the surface of the developer roller 134 may be 80% liquid and 20% solid. Increasing the concentration of solids in the printing fluid is referred to herein as "developing" the printing fluid, and the resulting printing fluid with the increased concentration is referred to herein as "developed printing fluid." The developed printing fluid may be a non-Newtonian fluid and may have a paste consistency.

During printing, the developed printing fluid may be transferred from the developer roller 134 to the photoconductor 142. The photoconductor 142 may be uniformly negatively charged with portions selectively discharged to form a latent image. The developer roller 134 may transfer the developed printing fluid to the selectively discharged portions of the photoconductor 142. Developed printing fluid not transferred to the photoconductor 142 may remain on the developer roller 134.

The developed printing fluid on the developer roller 134 may be cleaned off the developer roller 134 to enable future use of the developer roller 134 without any remnants of the printing fluid previously developed on the developer roller 134. In the illustrated example, the remaining developed printing fluid may be rotated by the developer roller 134 to a cleaner roller 136. The cleaner roller 136 may remove the remaining developed printing fluid from the developer roller 134. The cleaner roller 136 may be at a positive potential relative to the developer roller 134 to remove the unused printing fluid from the developer roller 134. In one example implementation, the cleaner roller 136 may be at a potential of −230 V. A wiper 137 may remove printing fluid from the cleaner roller 136. The sponge roller 138 may move the printing fluid away from the cleaner roller 136/wiper 137 area. The removed printing fluid may be remixed with undeveloped printing fluid, and a squeezer roller 139 may remove the printing fluid from the sponge roller 138 so that it can drain into a tray 133. The tray 133 may return the printing fluid to a reservoir.

The system 105 may include a controller 110 in communication with a power supply 120. In the illustrated example, there is a single integral controller 110 and a single integral power supply 120. In other examples, the functions of the controller 110 and the power supply 120 may be distributed among a plurality of controllers and power supplies. The power supply 120 may drive the potentials of the ITM 144, the photoconductor 142, the components of the developer unit 130, etc. The controller 110 may indicate to the power supply 120 the potential at which to set each component. As used herein, the term "controller" refers to hardware (e.g., a processor, such as an integrated circuit, or analog or digital circuitry) or a combination of software (e.g., programming such as machine- or processor-executable instructions, commands, or code such as firmware, a device driver, programming, object code, etc.) and hardware. Hardware includes a hardware element with no software elements such as an application specific integrated circuit (ASIC), a Field Programmable Gate Array (FPGA), etc. A combination of hardware and software includes software hosted at hardware (e.g., a software module that is stored at a processor-readable memory such as random access memory (RAM), a hard-disk or solid-state drive, resistive memory, or optical media such as a digital versatile disc (DVD), and/or executed or interpreted by a processor), or hardware and software hosted at hardware. The term "power supply" refers to hardware to output electrical energy at particular voltages. For example, the power supply may output electrical energy at voltages indicated to the power supply. The power supply may modify the voltages dynamically, for example, based on communications from the controller. The power supply may include software as well as hardware in some examples.

The controller 110 may determine that a wet null cycle is to occur and that the developer unit 130 should deliver liquid to the photoconductor 142 for transfer to the ITM 144. The controller 110 may instruct the power supply 120 to reduce a magnitude of an electrode voltage supplied to the electrode 131. The electrode voltage may be negative (i.e., the electrode 131 may be at a negative potential relative to ground), so reducing the magnitude may include increasing a negative electrode voltage so that it is closer to zero. The electrode 131 may develop printing fluid when it is at the voltage to which it is normally set for printing (a "printing voltage"). Reducing the magnitude of the electrode voltage may reduce the extent to which the electrode 131 develops the printing fluid or entirely prevent the electrode 131 from developing the printing fluid. Similarly, the magnitude of a voltage of the squeegee roller 135 may be reduced to reduce the development of printing fluid by the squeegee roller 135.

After the electrode 131 and the squeegee roller 135 stop developing printing fluid, there still may be developed printing fluid on the developer roller 134. After the electrode 131 and the squeegee roller 135 stop developing printing fluid, the voltages to cleaning components of the developer unit 130 may be left unmodified so that cleaning continues. The developer roller 134 may rotate so that the cleaner roller 136 is able to remove the developed printing fluid. The developer roller 134 may be rotating already when the electrode 131 stops developing printing fluid, or the developer roller 134 may be rotated starting after the electrode 131 stops developing printing fluid. In approximately one rotation, the entire surface of the developer roller 134 may be exposed to the cleaner roller 136.

The controller 110 may instruct the power supply 120 to set a developer roller voltage and a cleaner roller voltage each to about a wet null voltage. After the developer roller voltage and cleaner roller voltage are set to about the wet null voltage, little or no additional cleaning of the developer roller 134 may occur. The controller 110 may instruct the power supply 120 to reduce the electrode voltage at a first time, and the controller 110 may instruct the power supply 120 to set the developer roller 134 and the cleaner roller 136 to about the wet null voltage at a second time. The controller 110 may instruct the power supply 120 at the first and second time (e.g., if the power supply 120 responds approximately instantaneously), may instruct the power supply 120 a predetermined number of cycles before the first and second time (e.g., if the power supply 120 responds the predetermined number of cycles after receiving instructions), may include indications of the first and second time in the instructions, or the like. The first and second times may be far enough apart for most or all of the developed printing fluid to be cleaned from the developer roller 134.

There may be some error in the voltages output by the power supply 120 (e.g., an error of 0.1%, 0.5%, 1%, 2%, 5%, etc.). The error may result in minor amounts of development in an undesired direction if two components are set to a nominally identical voltage. For example, the cleaner roller 136 may develop printing fluid on the developer roller 134 if the cleaner roller 136 is at a more negative voltage than the developer roller 134. Similarly, the developer roller 134 may develop printing fluid on the electrode 131 or squeegee roller 135 if the developer roller 134 is at a more negative voltage than the electrode or squeegee roller 135. Accordingly, components to be set to about a same voltage may be set to nominal voltages separated by an offset to prevent development in an undesired direction. Thus, as used herein, the term "about" a particular voltage refers to a potential that is within an error margin of the particular voltage. The error margin may be a sum of the maximum error of each component, twice an approximate error at the particular voltage, or the like. For example, for a wet null voltage of −750 V, the developer roller voltage may be set to a nominal voltage of −750 V, and the cleaner voltage may be set to a nominal voltage of −735 V. Thus transitioning rollers to about a wet null voltage may include transitioning rollers to a set of voltages near the wet null voltage for one of the rollers.

Figure 2:
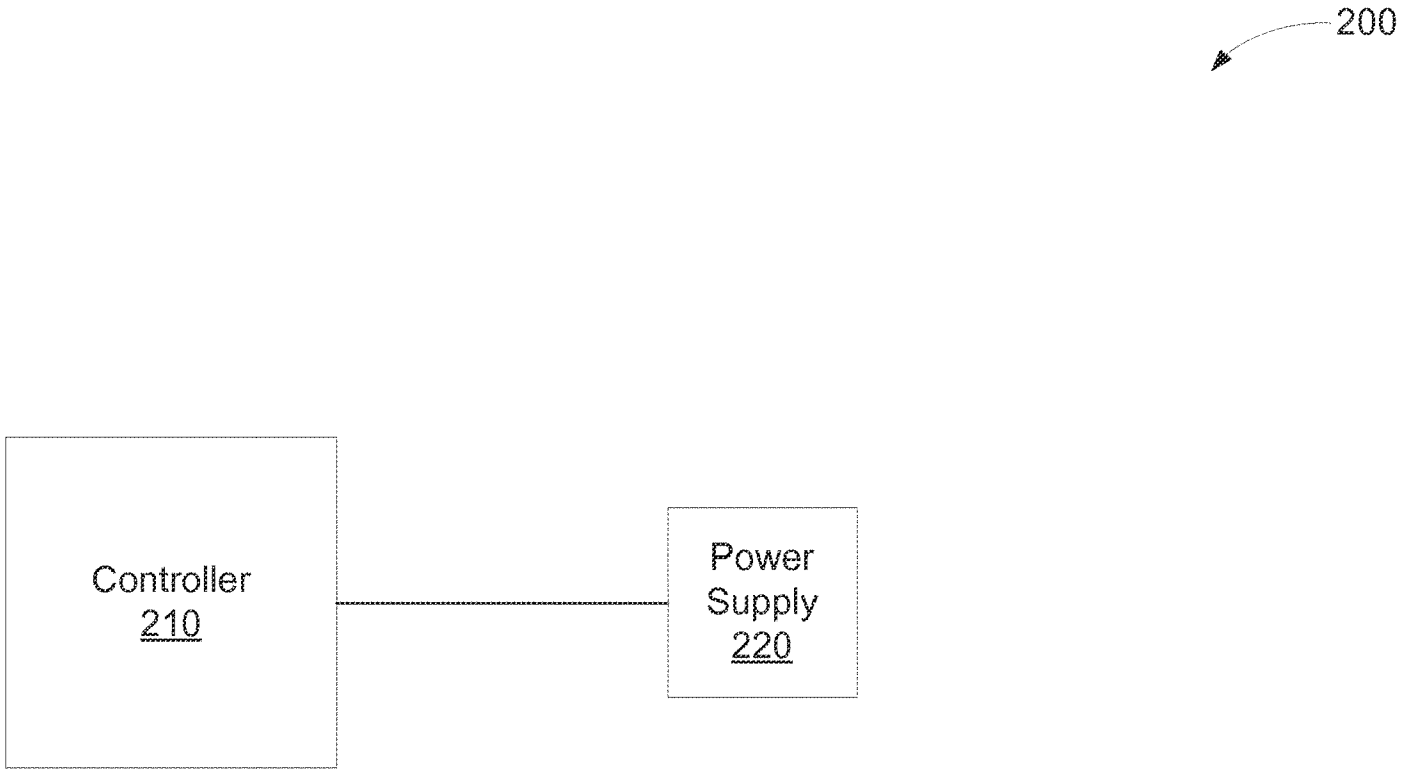
FIG. 2 is a schematic diagram of another example system to remove developed printing fluid from a developer roller and to set the developer roller to about a wet null voltage.

FIG. 2 is a schematic diagram of another example system 200 to remove developed printing fluid from a developer roller and to set the developer roller to about a wet null voltage. The system 200 may include a controller 210 and a power supply 220 communicatively coupled to the controller 210. The power supply 220 may be communicatively coupled to an electrode (not shown), a developer roller (not shown), and a cleaner roller (not shown). The controller 210 may instruct the power supply to reduce, at a first time, a magnitude of an electrode voltage supplied to the electrode. The electrode voltage may be reduced in magnitude to about the wet null voltage, reduced in magnitude to the developer roller voltage at the first time, or the like. Reducing the electrode voltage in magnitude to the developer roller voltage may prevent residual printing fluid development, but may require the electrode voltage to be later set to about the wet null voltage.

The controller 210 may also instruct the power supply to set, at a second time, a developer roller voltage and a cleaner roller voltage each to about a wet null voltage. In one example, the controller 210 or power supply 220 may monitor a current from the developer roller to the cleaner roller to determine when the developer roller has been sufficiently cleaned of developed printing fluid. The second time may be when the controller 210 or power supply 220 detects that the developer roller has been sufficiently cleaned. Alternatively, the controller 210 may wait a predetermined time between the first time and the second time. For example, the time to clean the developer roller may be measured or computed in advance, and the predetermined time may be stored by the controller 210. The predetermined time may be based on a geometry of the developer roller and a modification time of the electrode voltage. The geometry of the developer roller may include a rotation period of the developer roller (i.e., the time for the developer roller to make one rotation), a transit time between other rollers in contact with the developer roller, or the like. In an example, the predetermined time may be slightly less than the rotation period plus the modification time. The electrode voltage may decay exponentially when it is reduced in magnitude, so the modification time may be the time needed for the electrode voltage to be within a particular range of the target value, the time to decay a particular percentage, or the like.

Once developed printing fluid has been cleaned from the surface of the developer roller, a current may develop between the developer and the cleaner roller that is large enough to damage the developer roller or trip a current protection device (e.g., a fuse, a circuit breaker, etc.). Accordingly, a predetermined time determined based on a geometry of the developer roller plus a modification time may also include an offset that prevents an already clean portion of the developer roller from reaching the cleaner roller while the cleaner roller is still at a printing voltage (i.e., a voltage to which it is normally set during printing). Alternatively, the modification time may be defined based on the point in time at which there is no longer sufficient developed printing fluid to prevent excessive current from traveling through the cleaner-roller-developer-roller nip. The point in time at which there is no longer sufficient developed printing fluid to prevent excessive current may be determined by measuring the developer roller current or cleaner roller current to detect the excessive current. If the electrode voltage was set to the developer roller voltage at the first time, the electrode voltage may be set to about the wet null voltage at the second time. In one example, the electrode voltage may be set to a nominal voltage of −765 V for a developer roller voltage set to a nominal wet null voltage of −750 V.

Figure 3A:
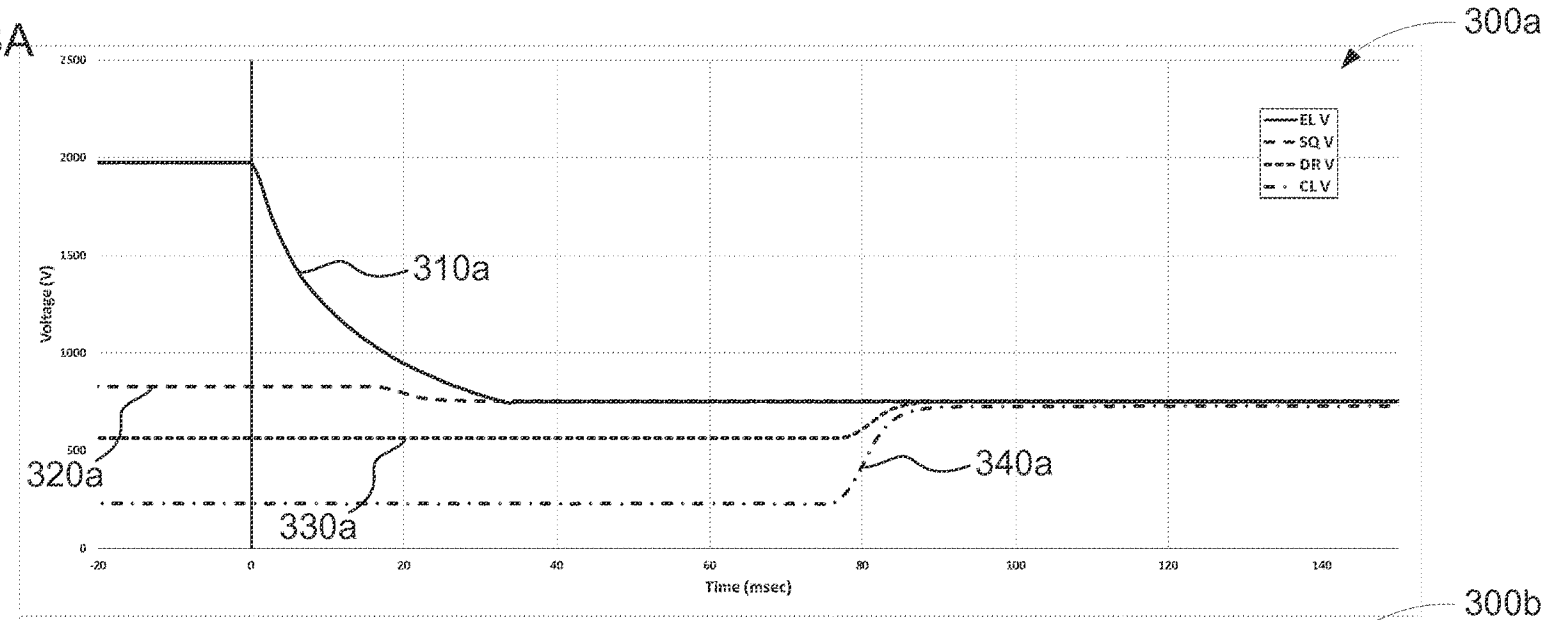
FIG. 3A is a chart of an example of developer unit voltages to clean a developer roller and to provide a wet null.
Figure 3B:
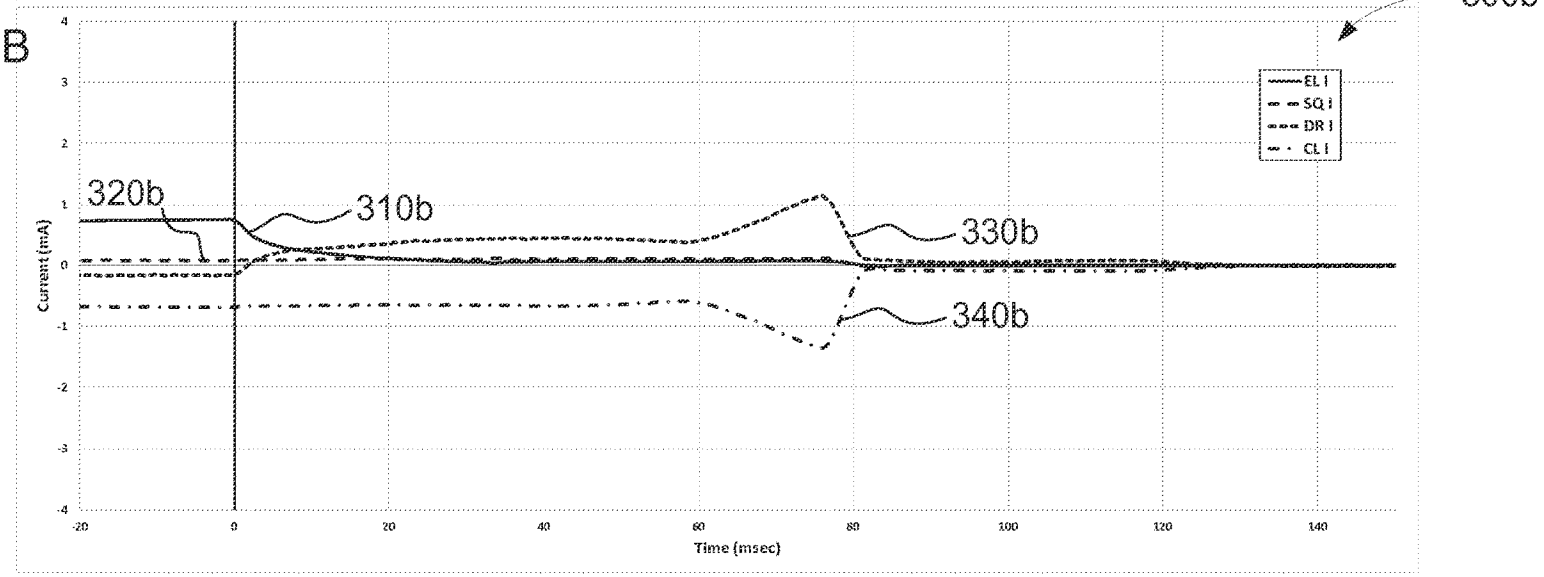
FIG. 3B is a chart of an example of developer unit currents for developer unit voltages to clean a developer roller and to provide the wet null.

FIG. 3A is a chart 300*a* of an example of developer unit voltages to clean a developer roller and to provide a wet null. FIG. 3B is a chart 300*b* of an example of corresponding developer unit currents for the developer unit voltages to clean the developer roller and to provide the wet null. At time zero, cleaning of the developer roller may be occurring, and transition to about a wet null voltages may begin. An electrode voltage 310*a* may be transitioned to about the wet null voltage at time zero. The electrode voltage 310*a* may decay exponentially towards the wet null voltage rather than transitioning near instantaneously. A squeegee voltage 320*a* may be transitioned to about the wet null voltage after the electrode voltage 310*a* has decayed most of the way towards the wet null voltage. The delay between the transitioning of the electrode voltage 310*a* to about the wet null voltage and the transitioning of the squeegee voltage 320*a* to about the wet null voltage may include a delay to compensate for the decay of the electrode voltage 310*a* and a delay to compensate for the transit time of the printing fluid between the electrode and the squeegee roller along the developer roller circumference. The electrode current 310*b* and the squeegee current 320*b* may decay close to zero as the electrode voltage 310*a* and the squeegee voltage 320*a* decay to about the wet null voltage.

In the illustrated example, a developer roller voltage 330*a* and a cleaner roller voltage 340*a* may be transitioned to about the wet null voltage approximately 55 milliseconds (ms) after the squeegee roller voltage 320*a* begins its transition to about the wet null voltage. For example, the developer roller may have a rotation period of about 60 ms, and there may be an approximately 40 ms delay between when a point on the developer roller passes the squeegee roller and when it passes the cleaner roller. Accordingly, about 40 ms after the squeegee roller voltage 320*a* begins transitioning to about the wet null voltage, the amount of developed printing fluid reaching the cleaner roller may start to decrease. The decrease in developed printing fluid reaching the cleaner roller may be indicated by a developer roller current 330*b* increasing in magnitude and a cleaner roller current 340*b* increasing in magnitude.

The developer roller current 330*b* and the cleaner roller current 340*b* may continue to increase in magnitude as the amount of developed printing fluid reaching the cleaner roller continues to decrease. In one example, it may take about 20 ms for the developer roller current 330*b* and the cleaner roller current 340*b* to reach an approximately constant value, which would indicate that the developer roller has been completely cleaned of developed printing fluid. However, in the illustrated example, the developer roller voltage 330*a* and the cleaner roller voltage 340*a* may be transitioned to about the wet null voltage beginning slightly less than 20 ms after the current begins increasing (i.e., before the developer roller current 330*b* and the cleaner roller current 340*b* have reach approximately constant values). The cleaner roller or developer roller may be damaged or a current protection device (e.g., a fuse, a circuit breaker, etc.) might be tripped if current flows between the rollers with very little printing fluid present. The developer roller voltage 330*a* and current roller voltage 340*a* may be transitioned to about the wet null voltage when most but not all of the developed printing fluid is removed from the developer roller to prevent damage caused by currents due to a developer roller with very little printing fluid.

Figure 3C:
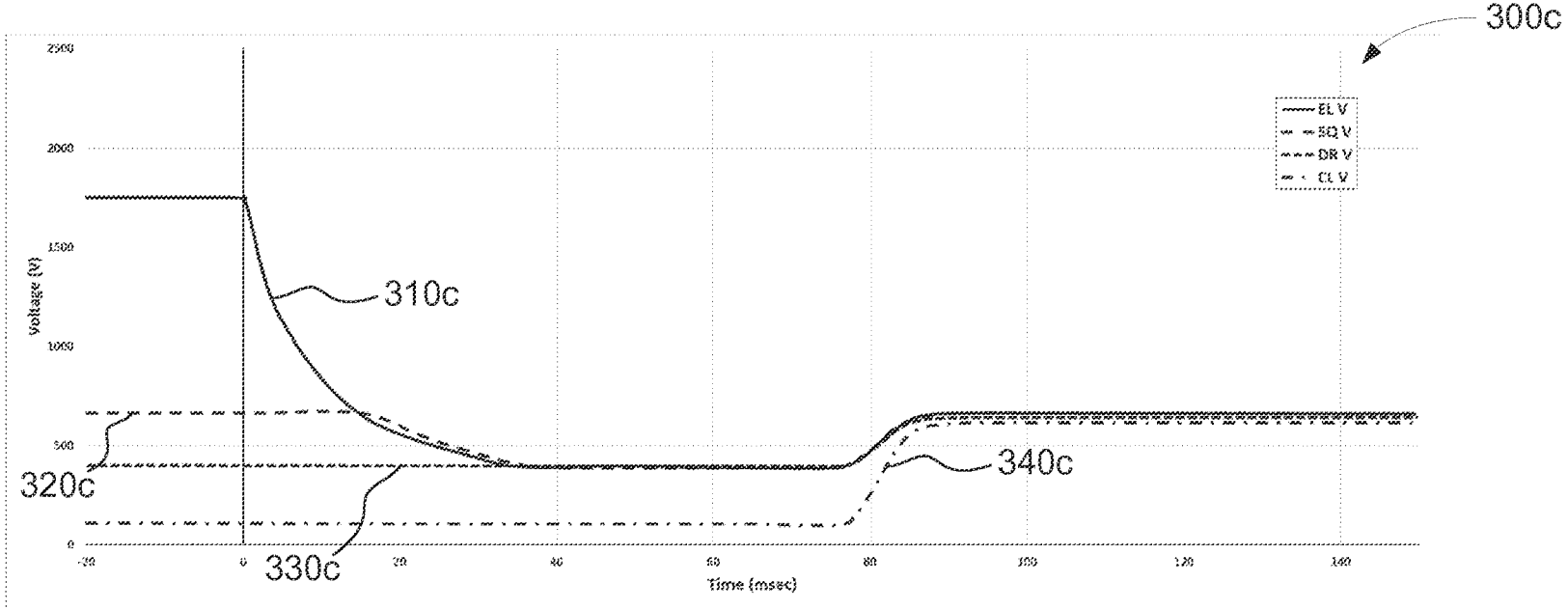
FIG. 3C is a chart of another example of developer unit voltages to clean a developer roller and to provide a wet null.

FIG. 3C is a chart 300*c* of another example of developer unit voltages to clean a developer roller and to provide a wet null. In the previous example, the electrode voltage 310*a* and squeegee voltage 320*a* transitioned to about the wet null voltage while the developer roller 330*a* remained at its original voltage. This may cause continued printing fluid development, which could result in additional background when printing resumes. In addition, with little or no printing fluid development occurring by the electrode, the squeegee may be able to reach a current limit that results in damage or the tripping of a current protection device. In the illustrated example, the electrode voltage 310*c* may be transitioned to the developer roller voltage 330*c* at time zero rather than to about the wet null voltage. Similarly, the squeegee voltage 320*c* may be transitioned to the developer roller voltage 330*c* after a delay.

When the developer roller voltage 330*c* is to be transitioned to the about wet null voltage, the electrode voltage 310*c* and the squeegee voltage 320*c* may be transitioned to about the wet null voltage at about the same time. The developer roller voltage 330*c* and the cleaner roller 340*c* voltage may be transitioned at about the same time they were transitioned in the previous example. The voltages 310*c*, 320*c*, 330*c*, 340*c* may be transitioned to about the wet null voltage in a coordinated fashion to prevent development from restarting. In an example, the developer roller voltage 330*c* may be transitioned to about the wet null voltage before the cleaner roller voltage 340*c* is transitioned to about the wet null voltage. For example, there may be an approximately 27 ms delay between when a point on the developer roller passes a photoconductor and when it passes the cleaner roller. Accordingly, the developer roller voltage 330*c* may be transitioned to about the wet null voltage approximately 27 ms before the cleaner roller voltage 340*c* is transitioned to about the wet null voltage in an example. In such an example, the cleaner roller voltage 340*c* may be modified when the developer roller voltage 330*c* is transitioned to about the wet null voltage to keep the potential difference between the developer roller and the cleaner roller about constant.

Figure 4:
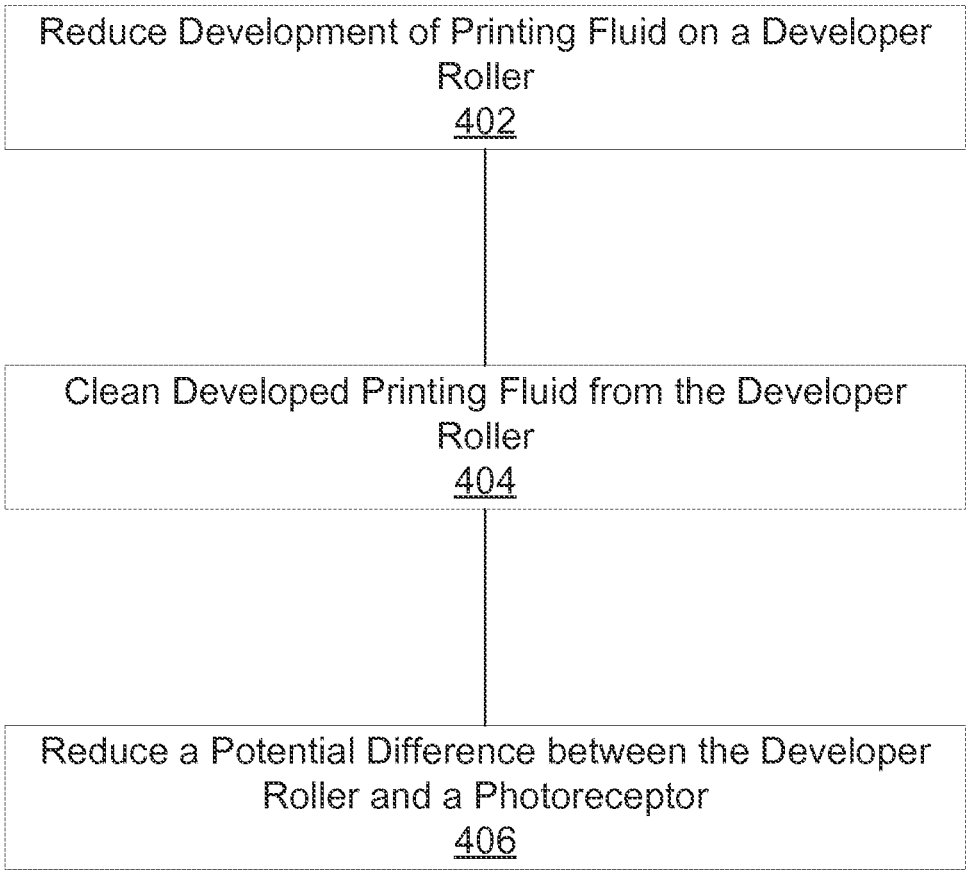
FIG. 4 is a flow diagram of an example of a method to remove developed printing fluid and to set a developer roller to about a wet null voltage.

FIG. 4 is a flow diagram of an example of a method 400 to remove developed printing fluid and to set a developer roller to about a wet null voltage. A processor may perform the method 400. At block 402, the method 400 may include reducing development of printing fluid on a developer roller. A potential difference between a component and the developer roller may allow the component to remove liquid from the printing fluid on the developer roller but not negatively charged solids, thereby increasing the concentration of solids. Reducing the potential differential may reduce the amount of development occurring. For example, the magnitude of a voltage at an electrode or a squeegee roller may be reduced to about a wet null voltage or to about a developer roller voltage to reduce the development of printing fluid on the developer roller.

Block 404 includes cleaning developed printing fluid from the developer roller. If the developer roller and a cleaner roller are already rotating and already have a potential difference, cleaning the developer roller may include continuing to rotate the developer and cleaner rollers and maintaining the potential difference. Alternatively, rotation of the developer roller or the cleaner roller may be started to clean the developed printing fluid from the developer roller, or a potential difference between the developer roller and the cleaner roller may be generated. The cleaner roller may remove developed printing fluid from the developer roller, for example, through physical contact of the cleaner roller with the developer roller and through movement of charged solids across the potential difference.

At block 406, the method 400 may include reducing a potential difference between the developer roller and a photoconductor. The developer roller voltage may be increased in magnitude to about the wet null voltage. At about the wet null voltage, the developer roller may be closer in potential to the photoconductor than when the developer roller is at a printing voltage. The wet null voltage may allow liquid to transfer from the developer roller to the photoconductor but with limited solids transferring to the photoconductor while decreasing a current between the developer roller and the photoconductor. The liquid may transfer from the photoconductor to an ITM to provide a wet null. In an example, the controller 110, the power supply 120, or the developer unit 130 of FIG. 1 may perform blocks 402, 404, or 406.

Figure 5:
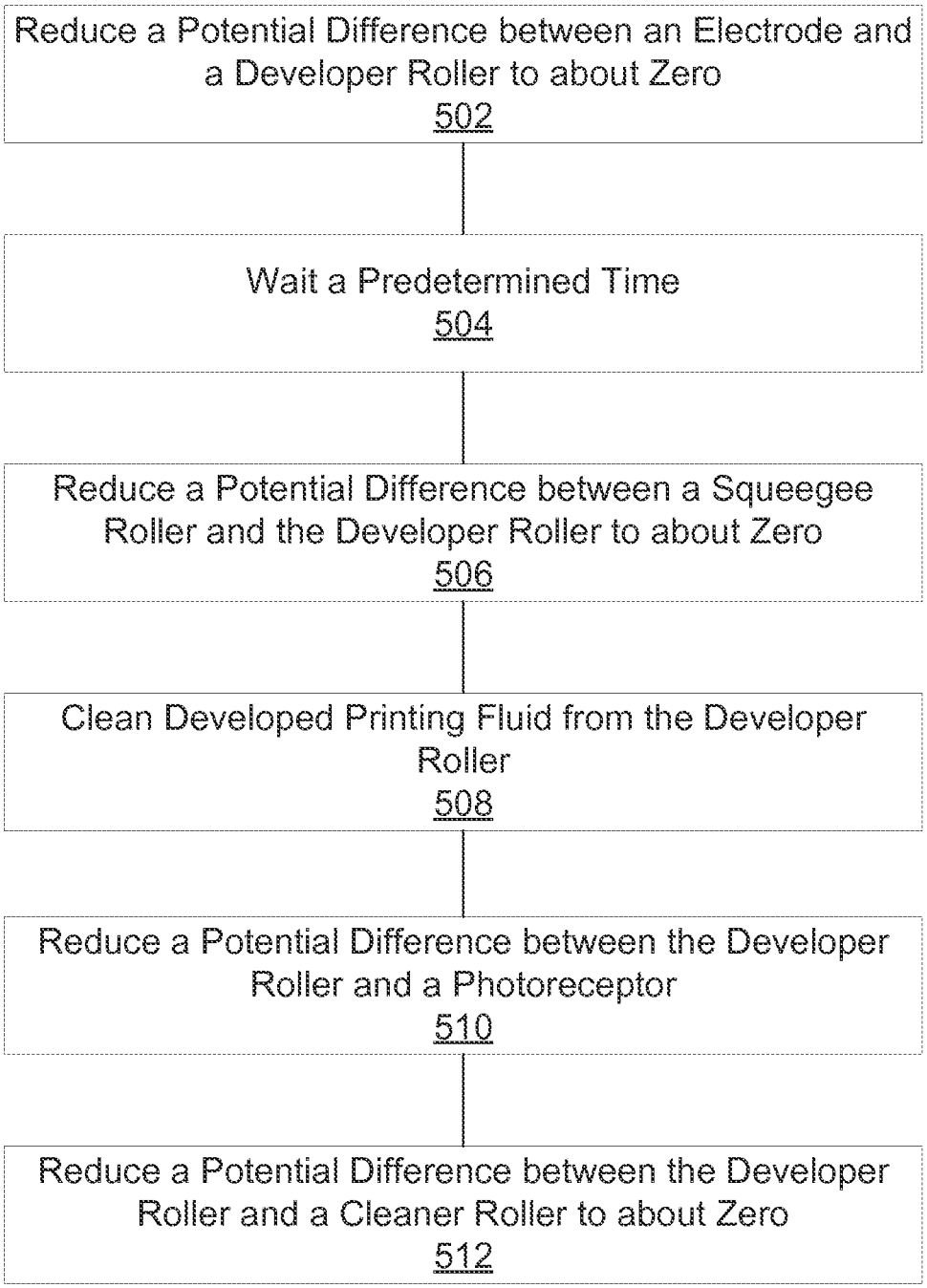
FIG. 5 is a flow diagram of another example of a method to remove developed printing fluid and to set a developer roller to about a wet null voltage.

FIG. 5 is a flow diagram of another example of a method 500 to remove developed printing fluid and to set a developer roller to about a wet null voltage. A processor may perform the method 500. Block 502 may include reducing a potential difference between an electrode and a developer roller to about zero. In the illustrated example, the electrode voltage is reduced to about the developer roller voltage rather than being reduced to about the wet null voltage. With almost zero potential difference between the electrode and the developer roller, there may be almost no printing fluid development occurring at the electrode.

At block 504, the method 500 may include waiting a predetermined time. The electrode voltage may decay exponentially over several milliseconds, so the predetermined time may be determined based on the time for the electrode voltage to decay by a particular amount. The predetermined time may also, or instead, be determined based on the time for a point on the surface of the developer roller to travel from the electrode to a squeegee roller. Block 506 may include reducing a potential difference between the squeegee roller and the developer roller, for example, after waiting the predetermined time. The potential difference between the squeegee roller and the developer roller may be reduced to about zero, which may reduce development of the printing fluid by the squeegee roller to a point where almost no development is occurring.

At block 508, the method 500 may include cleaning developed printing fluid from the developer roller. For example, a cleaner roller may clean the developed printing fluid from the developer roller. The cleaner roller may already be cleaning the developer roller, so cleaning developed printing fluid may include continuing to clean the developer roller. A predetermined time may pass to allow developed printing fluid to be cleaned from approximately the entire circumference of the developer roller. Block 510 may include reducing a potential difference between the developer roller and the photoconductor. Once developed printing fluid has been removed, the potential difference between the photoconductor and the developer roller may be decreased to reduce a current between the development roller and the photoconductor. The potential difference may be large enough to allow undeveloped printing fluid to wet the photoconductor and an ITM in contact with the photoconductor with minimal transfer of solids. Block 512 may include reducing the potential difference between the developer roller and the cleaner roller to about zero. Once the developer roller has been cleaned of developed printing fluid, additional cleaning may not be needed. Moreover, maintaining a potential when developed printing fluid is not present may damage the cleaner roller or the developer roller or may trip a current protection device. Accordingly, the potential difference between the developer roller and the cleaner roller can be reduced to about zero. In an example, the controller 110, the power supply 120, or the developer unit 130 of FIG. 1 may perform blocks 502, 504, 506, 508, 510, or 512.

Figure 6:
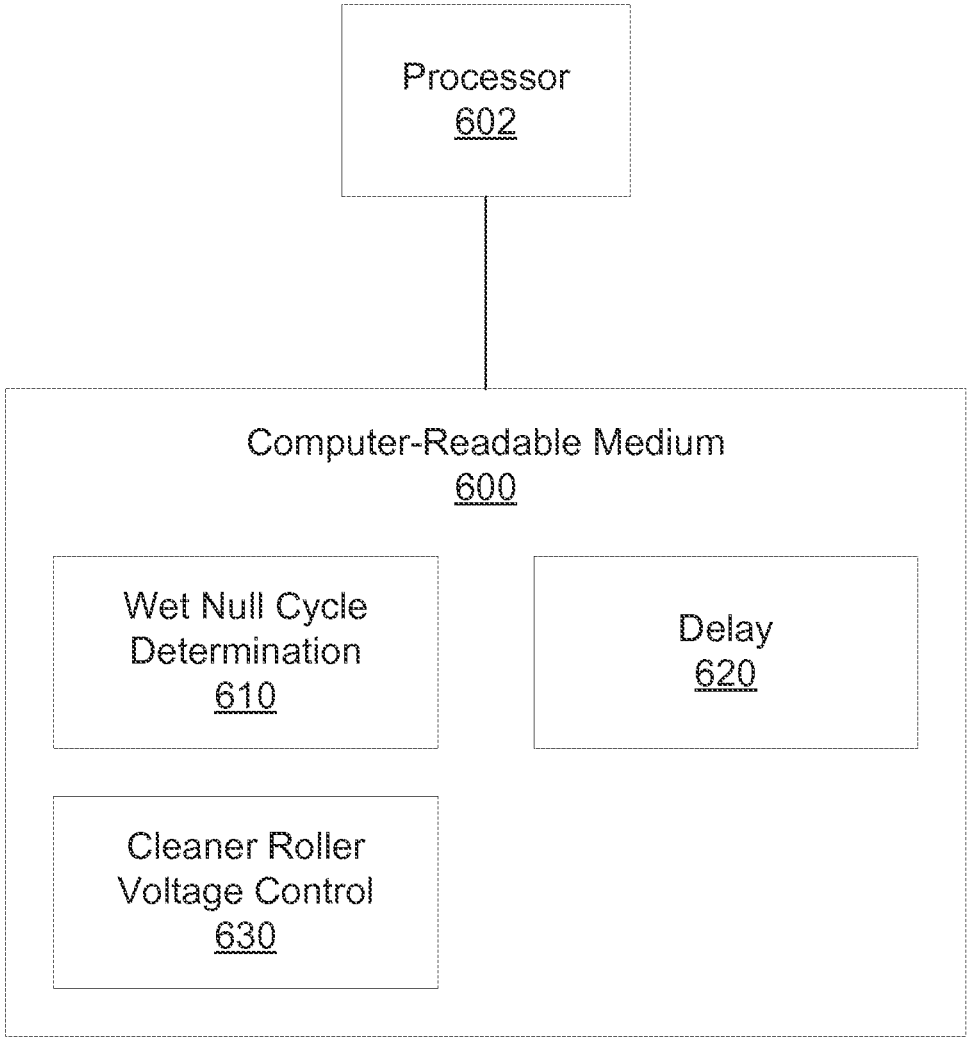
FIG. 6 is a block diagram of an example of a computer-readable medium to cause a processor to control voltages in a developer unit.

FIG. 6 is a block diagram of an example of a computer-readable medium 600, containing instructions that when executed by a processor 602, cause the processor 602 to control voltages in a developer unit. The computer-readable medium 600 may be a non-transitory computer readable medium, such as a volatile computer readable medium (e.g., volatile RAM, a processor cache, a processor register, etc.), a non-volatile computer readable medium (e.g., a magnetic storage device, an optical storage device, a paper storage device, flash memory, read-only memory, non-volatile RAM, etc.), and/or the like. The processor 602 may be a general purpose processor or special purpose logic, such as a microprocessor, a digital signal processor, a microcontroller, an ASIC, an FPGA, a programmable array logic (PAL), a programmable logic array (PLA), a programmable logic device (PLD), etc.

The computer-readable medium 600 may include a wet null cycle determination module 610. As used herein, a "module" (in some examples referred to as a "software module") is a set of instructions that when executed or interpreted by a processor or stored at a processor-readable medium realizes a component or performs a method. The wet null cycle determination module 610 may cause the processor 602 to determine that a wet null cycle is to occur. For example, the wet null cycle determination module 610 may cause the processor to receive an interrupt indicating a component of a printing device is requesting a null cycle.

The computer-readable medium 600 may include a delay module 620 to cause the processor 602 to wait for a developer roller in a developer unit to be cleaned. For example, the delay module 620 may cause the processor 602 to wait while developed printing fluid is removed from the developer roller. The delay module 620 may ensure that voltages are transitioned to about the wet null voltage in a proper sequence. The delay module 620 may cause the processor 602 to wait a predetermined time for the developer roller to be cleaned. For example, the predetermined time may be determined based on the geometry or operational characteristics of the developer unit (e.g., the circumference of the developer roller, the rotation period of the developer roller, the time for a point on the surface of the developer roller to travel between components, etc.). Alternatively, the delay module 620 may cause the processor 602 to determine dynamically how long to wait for the developer roller to be cleaned (e.g., based on measurements of current through the developer roller or a cleaner roller). The delay module 620 may cause the processor 602 to continue to maintain a potential difference between the developer roller and the cleaner roller. The delay module 620 or another component may cause the processor 602 to continue rotation of the developer roller and the cleaner roller during the wait. The delay module 620 may cause the processor 602 not to wait for the developer roller to be entirely clean, which may damage the developer roller or the cleaner roller, but rather to waft until the developer roller is almost entirely clean.

The computer-readable medium 600 may include a cleaner roller voltage control module 630. The cleaner roller voltage control module 630 may cause the processor 602 to indicate to a power supply to change a cleaner roller voltage to about a developer roller voltage. In one example, the developer roller voltage may be changing, and the cleaner roller voltage control module 630 may cause the processor 602 to indicate to a power supply to change the cleaner roller voltage to a target voltage to which the developer roller is being changed (e.g., about a wet null voltage). After the cleaner roller voltage is about equal to the developer roller voltage, little or no current may flow between the cleaner roller and the developer roller and little or no cleaning of the developer roller may occur. Referring to FIG. 2, the wet null cycle determination module 610, the delay module 620, or the cleaner roller voltage control module 630 when executed by the processor 602, may realize the controller 210.

Figure 7:
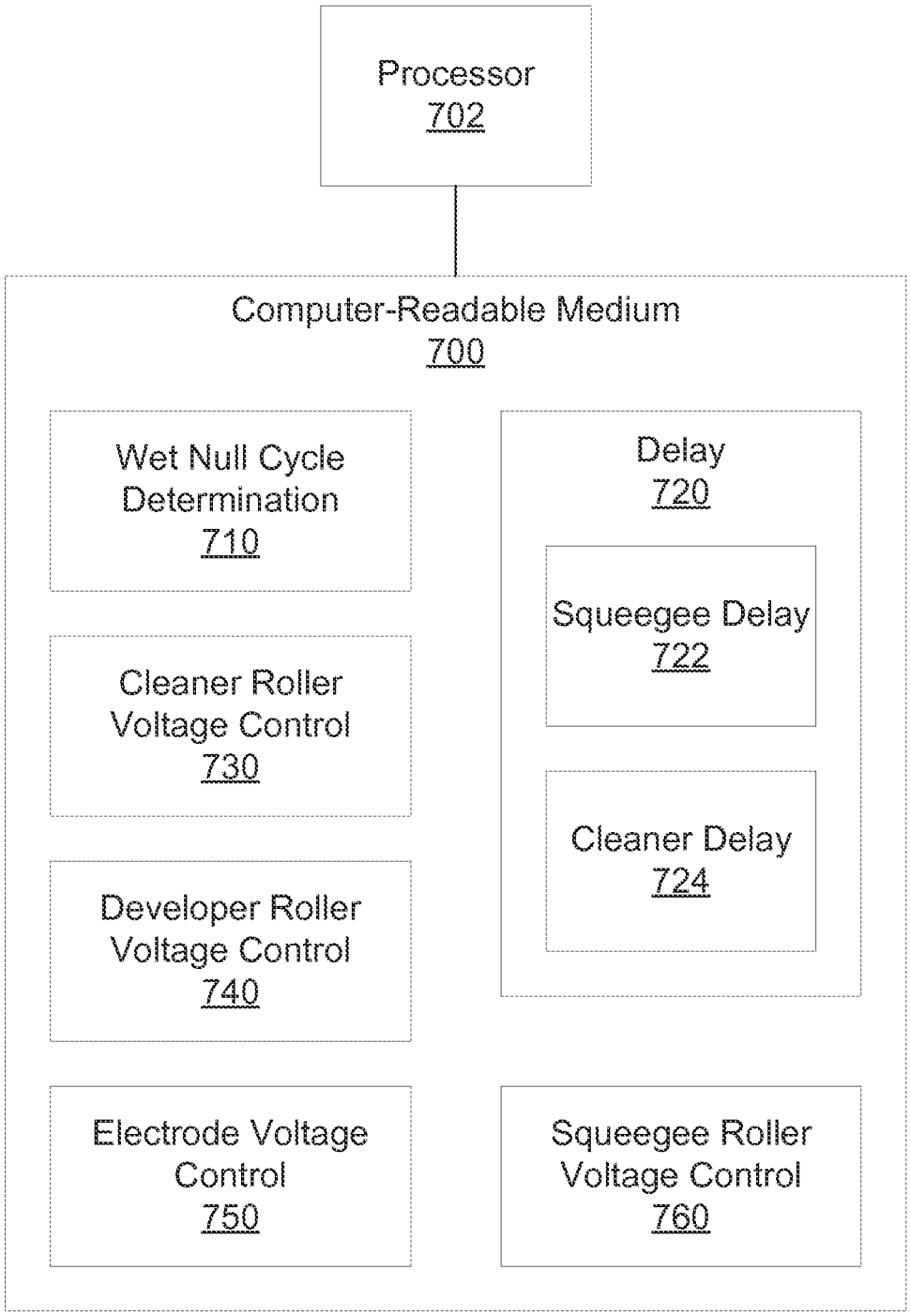
FIG. 7 is a block diagram of another example of a computer-readable medium to cause a processor to control voltages in a developer unit.

FIG. 7 is a block diagram of another example of a computer-readable medium 700, containing instructions that when executed by a processor 702, cause the processor 702 to control voltages in a developer unit. The computer-readable medium 700 may include a wet null cycle determination module 710. The wet null cycle determination module 710 may cause the processor 702 to determine that a wet null cycle is to occur, for example, by receiving an interrupt.

The computer-readable medium 700 may also include an electrode voltage control module 750, a squeegee roller voltage control module 760, a developer roller voltage control module 740, and a cleaner roller voltage control module 730. The electrode voltage control module 750 may cause the processor 702 to indicate an electrode voltage to a power supply. The squeegee roller voltage control module 760 may cause the processor 702 to indicate a squeegee voltage to the power supply. The developer roller voltage control module 740 may cause the processor 702 to indicate a developer roller voltage to the power supply. The cleaner roller voltage control module 730 may cause the processor 702 to indicate a cleaner roller voltage to the power supply. The voltage control modules 730, 740, 750, 760 may determine what voltages should be output by the power supply at various points in time and indicate the voltages to the power supply.

The computer-readable medium 700 may include a delay module 720. The delay module 720 may include a squeegee delay module 722 to cause the processor 702 to wait for developed printing fluid to be squeegeed. For example, the electrode voltage control module 750 may cause the processor 702 to indicate to the power supply to change the electrode voltage to about the developer roller voltage based on a determination a wet null cycle is to occur. The electrode may continue to develop printing fluid while it transitions to the developer roller voltage. In addition, once the electrode has stopped developing printing fluid, there may be a delay before undeveloped printing fluid reaches the squeegee roller. Accordingly, the squeegee delay module 722 may cause the processor 702 to wait for developed printing fluid to be squeegeed while the electrode voltage is transitioned and the undeveloped printing fluid travels to the squeegee roller. For example, the squeegee delay module 722 may cause the processor 702 to wait for the electrode voltage to transition a sufficient amount and for the undeveloped printing fluid to travel to the squeegee roller. Then, the squeegee roller voltage control module 760 may cause the processor 702 to indicate to the power supply to change the squeegee roller voltage to about the developer roller voltage. In one example, the squeegee delay module 722 may cause the processor 702 to wait a predetermined time (e.g., a time determined based on the geometry, operational characteristics, etc. of the printing device).

The delay module 720 may also include a cleaner delay module 724. The cleaner delay module 724 may cause the processor 702 to wait for a developer roller in a developer unit to be cleaned. For example, after the electrode and squeegee roller have stopped development of the printing fluid, there may still be developed printing fluid on the developer roller. The developed printing fluid may not have reached the cleaner roller and may not have been cleaned. The cleaner roller may continue to clean developed printing fluid from the developer roller during the delay. After the delay, once the developer roller has been sufficiently cleaned, the developer roller voltage control module 740 may cause the processor 702 to indicate to the power supply to change the developer roller voltage to about a wet null voltage. In addition, the cleaner roller voltage control module 730 may cause the processor 702 to indicate to the power supply to change the cleaner roller voltage to about the wet null voltage as well. Accordingly, in the illustrated example, the cleaner delay module 724 may specify delays for both the developer roller and the cleaner roller. In other examples, there may be a separate developer delay module for the developer roller.

In some examples, the electrode voltage control module 750 and the squeegee roller voltage control module 760 also may cause the processor 702 to increase the electrode voltage and the squeegee roller voltage respectively to about the wet null voltage. In one example, the cleaner delay module 724 may cause the processor 702 to wait a predetermined time (e.g., a time determined based on the geometry, operational characteristics, etc. of the printing device). Referring to FIG. 2, the wet null cycle determination module 710, the delay module 720, the squeegee delay module 722, the cleaner delay module 724, the cleaner roller voltage control module 730, the developer roller voltage control module 740, the electrode voltage control module 750, or the squeegee roller voltage control module 760 when executed by the processor 702, may realize the controller 210.

The above description is illustrative of various principles and implementations of the present disclosure. Numerous variations and modifications will become apparent to those skilled in the art once the above disclosure is fully appreciated. Accordingly, the scope of the present application should be determined only by the following claims.

What is claimed is:

1. A system, comprising:

a power supply electrically coupled to an electrode, a developer roller, and a cleaner roller; and a controller to:

instruct the power supply to reduce, at a first time, a magnitude of an electrode voltage supplied to the electrode, and instruct the power supply to set, at a second time, a developer roller voltage and a cleaner roller voltage each to about a wet null voltage, wherein the wet null voltage causes liquid carrier to be transferred from the developer roller to a photoconductor, and wherein the photoconductor is to transfer the liquid carrier to an intermediate transfer member.

2. The system of claim 1, wherein the controller is to wait a predetermined time between the first time and the second time.

3. The system of claim 2, wherein the predetermined time is based on a geometry of the developer roller and a modification time to reduce the electrode voltage.

4. The system of claim 1, wherein the controller is to instruct the power supply to reduce the electrode voltage to about match the developer roller voltage at the first time.

5. The system of claim 4, wherein the controller is to instruct the power supply to set the electrode voltage to about the wet null voltage at the second time.

6. The system of claim 1, further comprising the cleaner roller, wherein the cleaner roller is to remove developed printing fluid from the developer roller between the first time and the second time.

7. The system of claim 1, further comprising the developer roller, a photoconductor, and an intermediate transfer member, wherein the developer roller is to transfer liquid with few or no solids to the photoconductor while the developer roller is at the wet null voltage, and wherein the photoconductor is to transfer the liquid to the intermediate transfer member.

8. A method, comprising:

reducing development of printing fluid on a developer roller in contact with a photoconductor;

cleaning developed printing fluid from the developer roller;

reducing a potential difference between the developer roller and the photoconductor to transfer liquid carrier with few or no solids to the photoconductor; and transfer the liquid carrier with few or no solids from the photoconductor to an intermediate transfer member.

9. The method of claim 8, wherein reducing development of printing fluid includes reducing a potential difference between an electrode and the developer roller and reducing a potential difference between a squeegee roller and the developer roller.

10. The method of claim 9, wherein reducing development of printing fluid includes waiting a predetermined time after reducing the potential difference between the electrode and the developer roller before reducing the potential difference between the squeegee roller and the developer roller.

11. The method of claim 9, wherein reducing the potential difference between the electrode and the developer roller comprises reducing the potential difference between the electrode and the developer roller to about zero, and wherein reducing the potential difference between the squeegee roller and the developer roller comprises reducing the potential difference between the squeegee roller and the developer roller to about zero.

12. The method of claim 8, further comprising reducing a potential difference between the developer roller and a cleaner roller to about zero.

13. The method of claim 8, further comprising initially determining a wet null cycle is to occur.

14. The method of claim 8, further comprising transferring liquid from the developer roller to the photoconductor with limited solids transferring, and transferring liquid from the photoconductor to an intermediate transfer member.

15. A non-transitory computer-readable medium comprising instructions that, when executed by a processor, cause the processor to:

determine a wet null cycle is to occur;

perform a wet null cycle, wherein the instructions to perform the wet null cycle include instructions that cause the processor to:

wait for a developer roller in a developer unit to be cleaned; and indicate to a power supply to change a cleaner roller voltage to about a developer roller voltage.

16. The computer-readable medium of claim 15, wherein the instructions, when executed by the processor, cause the processor to:

indicate to the power supply to change the developer roller voltage to about a wet null voltage after waiting; and indicate to the power supply to change the cleaner roller voltage to about the developer roller voltage by indicating to the power supply to change the cleaner roller voltage to about the wet null voltage.

17. The computer-readable medium of claim 15, wherein the instructions, when executed by the processor, cause the processor to indicate to a power supply to change an electrode voltage and a squeegee roller voltage to about the developer roller voltage based on the determination the wet null cycle is to occur.

18. The computer-readable medium of claim 17, wherein the instructions, when executed by the processor, cause the processor to, after the indication to change the electrode voltage, wait for developed printing fluid to be squeegeed before indicating to the power supply to change the squeegee roller voltage to about the developer roller voltage.

19. The computer-readable medium of claim 15, wherein the instructions, when executed by the processor, cause the processor to wait for the developer roller to be cleaned by waiting a predetermined time.

20. The computer-readable medium of claim 15, wherein the instructions, when executed by the processor, cause the processor to determine the wet null cycle is to occur by receiving an interrupt.

21. The computer-readable medium of claim 15, wherein the instructions, when executed by the processor, cause the processor to cause heat and charge to be delivered to the intermediate transfer member during the wet null cycle.

* * * * *